US009840351B1

(12) United States Patent
Russell et al.

(10) Patent No.: US 9,840,351 B1
(45) Date of Patent: Dec. 12, 2017

(54) DIVIDABLE SHIPPING PACKAGE

(71) Applicant: Amazon Technologies, Inc., Reno, NV (US)

(72) Inventors: Paul Grady Russell, Campbell, CA (US); John Kelly Cornell, Campbell, CA (US); Patrick Dean Lewis, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 472 days.

(21) Appl. No.: 14/222,411

(22) Filed: Mar. 21, 2014

(51) Int. Cl.
*B65D 85/00* (2006.01)
*B65D 25/04* (2006.01)
*B65D 5/54* (2006.01)
*B65D 85/10* (2006.01)

(52) U.S. Cl.
CPC ..... *B65D 25/04* (2013.01); *B65D 5/5445* (2013.01); *B65D 85/1072* (2013.01)

(58) Field of Classification Search
CPC ..... B65D 5/5445; B65D 25/04; B65D 65/16; B65D 85/1054; B65D 85/1072
USPC ..... 206/144, 386, 597, 459.5; 229/87.05, 229/101.1, 200, 203, 204, 235, 238, 239
See application file for complete search history.

(56) References Cited

U.S. PATENT DOCUMENTS 1,815,800 A * 7/1931 Respess ..... B65D 77/32 206/1.9
3,043,490 A * 7/1962 Burnett ..... B65D 5/5445 206/558
3,360,120 A * 12/1967 Getzin ..... B01D 46/0098 206/526
4,778,057 A * 10/1988 Allen ..... B65D 75/5888 206/494
4,827,114 A * 5/1989 Blachon ..... B65D 65/16 235/487
5,181,607 A * 1/1993 Focke ..... B65D 85/1072 206/192
5,662,215 A * 9/1997 Focke ..... B65D 85/1072 206/273
6,102,277 A * 8/2000 Krapohl, Sr. ..... B65D 5/0005 229/101.2
6,371,365 B1 * 4/2002 Doucette ..... B65D 5/5445 229/120.011
7,228,961 B2 * 6/2007 Koetter ..... B65D 85/1018 206/271
2002/0177513 A1 * 11/2002 Focke ..... B65B 19/228 493/63
2005/0247583 A1 * 11/2005 Koetter ..... B65D 85/1018 206/242
2005/0247766 A1 * 11/2005 DeBusk ..... B65D 5/0005 229/101.1
2006/0255105 A1 * 11/2006 Sweet ..... B65D 5/0005 229/101.2

(Continued)

*Primary Examiner* — Luan K Bui
(74) *Attorney, Agent, or Firm* — Lee & Hayes, PLLC

(57) ABSTRACT

This disclosure describes, in part, systems and methods for utilizing a dividable package for efficient shipment of items. The dividable package includes two or more internal compartments for securing items for shipment, the internal compartments enclosed by a cover having a detachment mechanism. Upon activation of the detachment mechanism, previously covered labels on each of the internal compartments identifying the items within are exposed.

19 Claims, 12 Drawing Sheets

(56) References Cited

U.S. PATENT DOCUMENTS

| | | | | |
|---|---|---|---|---|
| 2008/0017531 | A1* | 1/2008 | Tanbo | B65D 75/5827<br>206/264 |
| 2008/0142578 | A1* | 6/2008 | Vickerstaff | B65D 85/1054<br>229/125.37 |
| 2012/0279882 | A1* | 11/2012 | Prahm | B65D 85/1072<br>206/259 |
| 2013/0112742 | A1* | 5/2013 | D'Amato | A47G 21/001<br>229/201 |

* cited by examiner

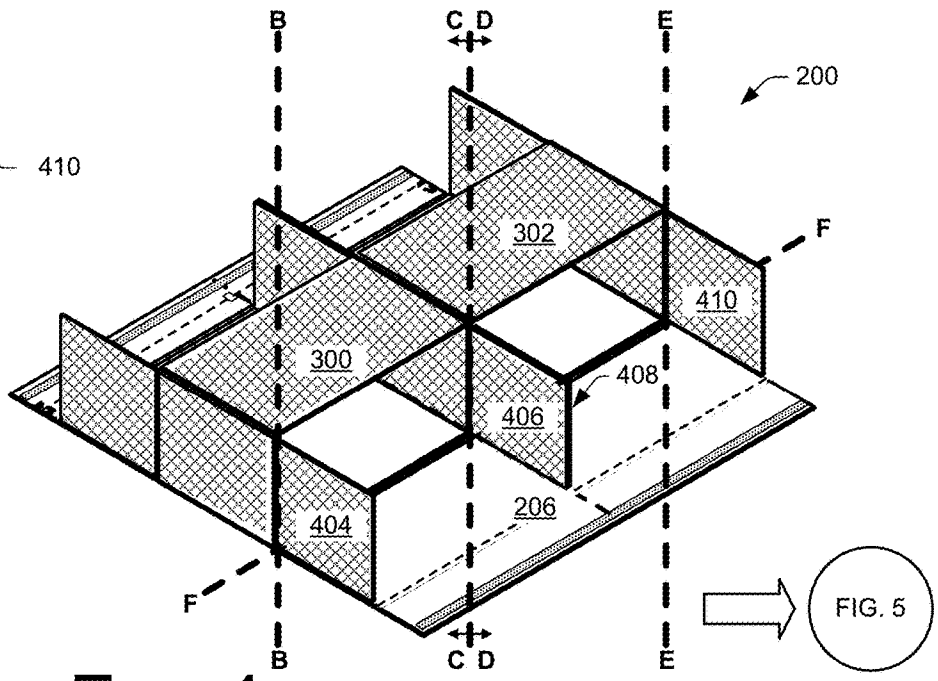
FIG. 4
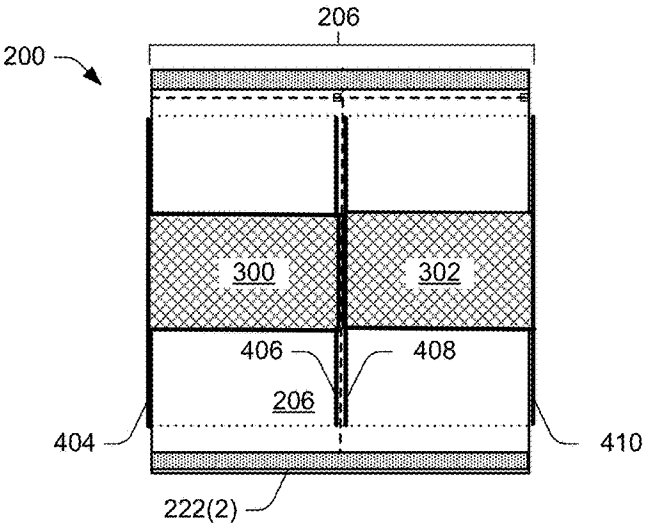
FIG. 5
FIG. 3

DIVIDABLE SHIPPING PACKAGE

BACKGROUND

Product distributors may require certain constraints or limitation on the way various products are packaged and shipped to them. For instance, a product distributor may require that products are packaged in smaller quantities. In addition, the distributor may require that the packages of smaller quantities be positioned on a pallet such that the package identification labels are facing outward. Unfortunately, often times such constraints are inefficient since they fail to fully utilize the entire surface of the pallet. For instance, meeting these constraints in some cases may result in the interior space of the pallet not being efficiently used. Therefore, a packaging technique is needed to increase the efficiency of the packaging and shipping process while meeting the various constraints of the product distributor.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

FIGS. 3-7 illustrate example steps of folding, labeling, packing, sealing, and dividing an example dividable package.

DETAILED DESCRIPTION

Overview

Figure 1:
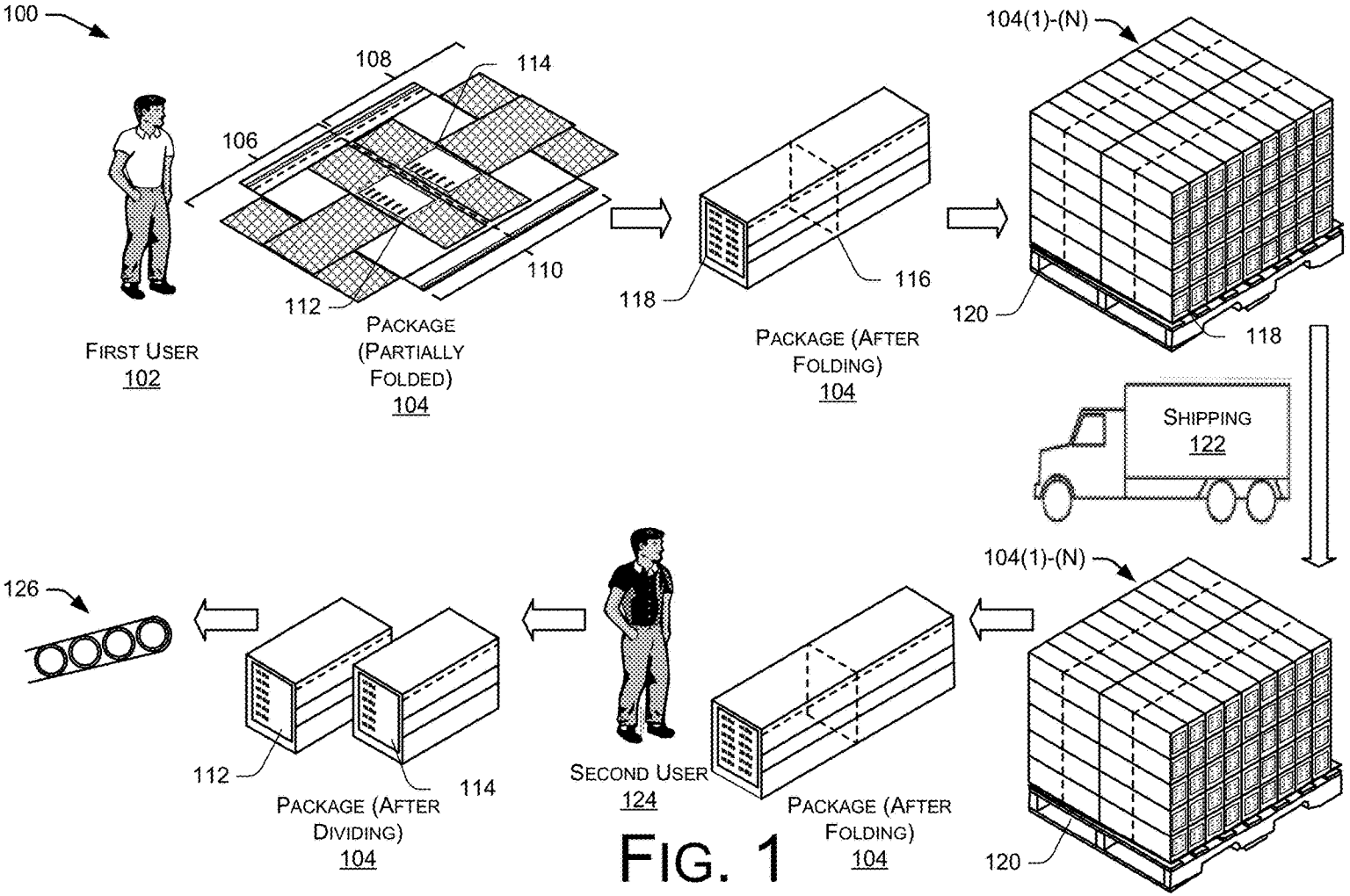
FIG. 1 illustrates an example environment of using a dividable package to ship items from a first user to a second user, where the second user may divide the dividable package upon receipt.

This disclosure describes, in part, systems and methods for utilizing a dividable package for shipping items. In some implementations, the dividable package may have a cover surrounding or enclosing two separate internal compartments that function to secure items. Upon arrival of the dividable package at a shipping destination, the recipient may separate the cover, by activating a detachment mechanism, into two smaller units with each having one of the internal compartments for processing and/or further distribution of the items.

Traditionally, in as effort to comply with distributors processing facility requirements, packages are generally limited to a small number of items. Thus, in some instances, this would require shipping many smaller packages to accommodate the limited quantity requirement of the distributor. Furthermore, the distributors may require that each package be easily identified on a shipping pallet, by, for example, requiring that all shipping labels for each of the smaller packages be positioned toward the exterior of the pallet for ease in scanning. However, complying with these requirements may be highly inefficient because less than an ideal number of packages may be arranged on a given pallet.

To illustrate, envision an electronic device distributor that limits a package size to no more than six handheld electronic devices while requiring each package to be placed on a pallet so that a label on each is facing outward. In this example, placement of each small package around the edge of the pellet would result in a chimney-like configuration having a large portion of unused space on the interior of the pellet.

To overcome these obstacles, the dividable package described below may allow for more efficient use of the interior portion of the pallet while allowing compliance with distributors processing facility requirements of overall package size limitations and/or shipping configurations.

As mentioned above, in some implementations, the dividable package may contain two or more internal compartments detachably housed within a cover. Each internal compartment may be used to secure content during shipment. For instance, each internal compartment may secure electronic devices, such as mobile telephones, electronic book reader devices, tablets, or the like as they are shipped from a device manufacturer to a distributor. In some implementations, each internal compartment of the dividable package may be configured to secure the same type of content within each compartment. However, in other implementations illustrated below, each internal compartment may be configured to secure different types of products or content.

The internal compartments of the dividable package may each have a packing label identifying the products or items located within. In some implementations, where the internal compartments remain housed within the cover, the packing labels of each internal compartment are not visible on any external surfaces of the dividable package.

As mentioned above, the cover of the dividable package may hold the internal compartment of the dividable package together. In some implementations, the dividable package may have a master shipping label identifying the items located within each of the internal compartments while the internal compartments remain housed within the cover.

In some implementations, the cover may have an integrated detachment mechanism such that a user may utilize the detachment mechanism to separate the internal compartment of the dividable package. For instance, the cover may have a ripcord detachment mechanism that when pulled, cuts a portion of the cover to divide the cover into two separate covers each housing an internal compartment and the items within.

Upon separation of the cover and the internal compartments, the packing labels of each internal compartment may become visible and separately identify the contents of each internal compartment of the divided package. Thus, the separated packages may be ready from additional processing and shipment without additional packaging modifications.

While this disclosure describes shipping the dividable package(s) generally between a product manufacturer and product distributor, the package(s), whether divided or undivided, may be shipped or distributed to retailer, wholesalers, or directly to consumers.

The techniques for utilizing a dividable package for shipping items may be implemented in many ways. Example implementations are provided below with reference to the figures.

Example Dividable Package

FIG. 1 is an illustrative example environment 100 for utilizing an example dividable package. In this example environment 100, a first user 102, such as an employee of a manufacturer, may utilize dividable package 104 to secure items (not pictured) for shipment. In some implementations, the dividable package 104 may be fabricated as single unit and stored substantially flat prior to use by user 102. In one example, the dividable package 104 may be formed of a corrugated material. For instance, the dividable package 104 may be formed of a corrugated fiberboard (e.g., single wall, double wall, or triple wall corrugated fiberboard), a corrugated plastic, or a combination of the like (e.g., corrugated plastic internal compartments and a corrugated fiberboard cover).

As described in detail below, the example dividable package 104 may be folded by user 102 or a machine (not shown) in a particular sequence to create at least two internal compartments for securing items for shipment. In some implementations, the dividable package may have a first internal compartment 106 and a second internal compartment 108 both of which may be sub-packages of the dividable package 104. In some implementations, a cover 110 may enclose or surround the first internal compartment 106 and a second internal compartment 108 after the dividable package 106 is folded. As shown in the "partially folded" dividable package 104, each internal compartment 106 and 108 may have a location for attachment of shipping label 112 and 114 respectively. Shipping label 112 and 114 may be adhesive backed material containing the identity of the items secured within the internal compartments. For instance, where the items within internal compartment 106 are electronic devices, the shipping label 112 may contain the unique identifiers of each electronic device secured within internal compartment 106 (e.g., serial numbers, serial codes, unique device identification (UDI), universal product code (UPC), stock keeping unit (SKU), Global Trade Item numbers (GTIN), or Amazon Standard Identification Number (ASIN)).

The cover 110 of the dividable package 104 may have a detachment mechanism 116 which, upon activation, may separate the internal compartments 106 and 108 of the dividable package into two packages. In some implementations, the detachment mechanism 116 may be a plastic band or ripcord integrated with the cover, tear tape, tear-off ribbon, or other polymer-based band to provide easy division of the dividable package 104. In some implementations, the detachment mechanism 116 may be incorporated with the cover 110 to cut the cover 110 as a user pulls to detachment mechanism 116. However, in other implementations, the detachment mechanism 116 may be placed on the cover to connect the separate compartments of the dividable package 104.

Once the dividable package 104 is folded by user 102, the shipping labels 112 and 114 may not be visible on the external portion of the dividable package 104 while the internal compartments are securing items and/or enclosed by cover 110. For instance, the shipping labels 112 and 114 may be facing each other substantially perpendicular to the detachment mechanism 116 on the cover 110.

In some implementation, a master shipping label 118 may be placed or disposed on an exterior surface of the folded dividable package 104. For instance, the master shipping label 118 may be placed on an end location of either internal compartment 106 or 108. The master shipping label 118 may contain the contents of both of the shipping labels 112 and 114 on each of the internal compartments to identify the entire contents of the folded dividable package 104. In some implementation, the master shipping label 118 may include identification information that is different than the identification information presented on the shipping labels 112 and 114.

Once the user 102 folds and packs several dividable packages, the user 102 may place each dividable package 104(1)-(N) on a platform for shipment (i.e., pallet). As illustrated, the dividable packages are placed on a pallet 120 such that the master shipping label 118 of each package is facing outward and accessible to user 102 and other users. In addition, the depth of each dividable package 104(1)-(N) allows for use of the interior space of the pallet 120. For instance, an end of a dividable package that does not contain a master shipping label may abut the end of another dividable package that does not contain a master shipping label. In this manner, a maximum number of dividable packages may be placed on the pallet, thereby efficiently using the entire pallet space.

FIG. 1 illustrates that the pallet 120 holding the dividable packages 104(1)-(N) may be shipped to a second location, such as a distributor. Shipping 122 is shown as moving the pallet by a truck; however, other methods of shipment are envisioned (e.g., boat, airplane, train, etc.). Upon arrival at the second location, a second user 124 may remove the folded dividable package 104 for the pallet 120. In some implementations, the second user 124 may activate the detachment mechanism 116 on the cover 110 to divide the folded dividable package 104 into the two internal compartments 106 and 108.

Upon division of the folded dividable package 104, each shipping label 112 and 114 on each of the internal compartments may become visible for the second user 124. In some implementations, each half of the divided package 104 may then be further processed by the user 124. For instance, the second user 124 may place each half of the divided package 104 onto a conveyor system 126 for processing and possible further shipment.

As such, the example environment 100 illustrates the efficient shipment of items in the dividable package 104 that allow for utilization of an entire surface of a pallet 120 and display of a master shipping label 118 for each dividable package on the pallet 120. In addition, separation by the second user 124 of the dividable package 104 upon arrival, may allow for easy transition to the second user's processing equipment since the package complies with a smaller size requirement and comes with a pre-fixed shipping label to identify the contents of the now divided packages.

It should be understood that while FIG. 1 refers to and illustrates the first user 102 and the second user 124 as human users, users 102 and/or 124 may in whole or in part refer to a mechanical user to provide automated folding, packing, processing, and/or separating of the dividable package.

Figure 2:
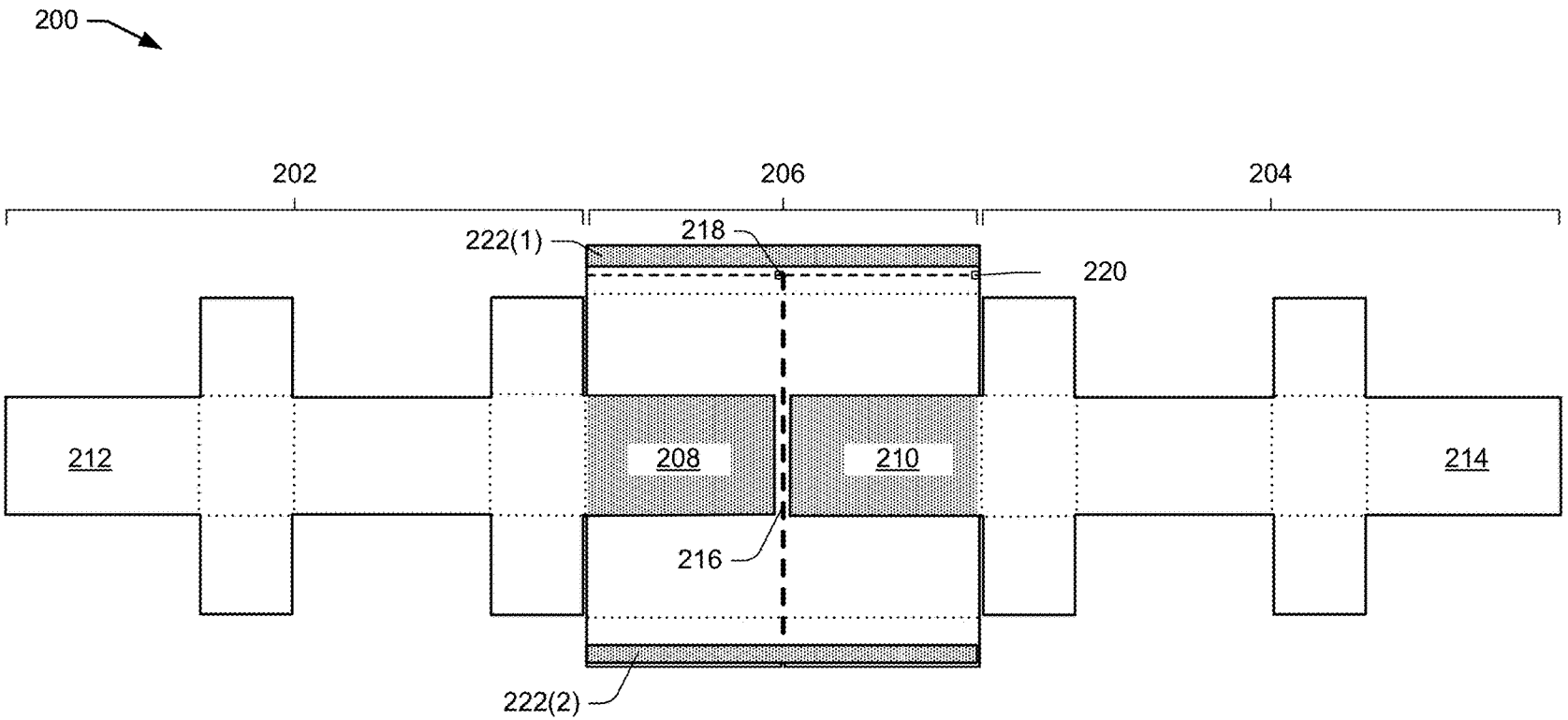
FIG. 2 illustrates an example configuration of an unfolded dividable package having a detachment mechanism traveling the entire length of a dividable package cover.

FIG. 2 illustrates an example configuration of a dividable package 200. In some implementations, the dividable package 200 may have three main sections. As described below, a first section 202 may be folded to form a first internal compartment and a second section 204 may be folded to form a second internal compartment, while a third section or cover 206 may enclose the internal compartments once formed. FIG. 2 illustrates that each of the sections may be constructed of a foldable boxboard capable of being scored to allow bending along the scored lines without fracture. In this instance, the locations of the scoring on the sections are shown as dotted lines.

In some implementations, the first and second sections 202 and 204 may be attached to the cover 206 with glue. In this instance, glue may hold an area 208 of the first section 202 to the cover 206 and hold an area 210 of second section 204 to the cover 206. In this implementation, the first and second sections 202 and 204 may be sub-packages within the dividable package 200. In other implementations, the first and second sections may be attached to the cover 206 by other methods (e.g., staples, adhesives, etc.). In yet other implementations, each of the first and second sections 202 and 204 and cover 206 may be constructed of a single piece of corrugated material.

In some implementations, in order to begin to form an internal compartment from the first section 202, area 212 may be folded over such that the backside of area 212 (i.e., the inverse side of area 212 presented in FIG. 2) may be placed over the area 208. In this implementation, the scored lines may bend to allow for formation of a rectangular section and the beginning structure of the internal compartment. In some implementations, area 212 and area 208 may be held in place with glue, adhesives, staples, or the like. In a similar fashion, an internal compartment may also be formed from the second section 204 by placing the backside of area 214 over area 210.

The cover 206 is configured to have a length to substantially surround each internal compartment formed from the first and second sections 202 and 204 and include a detachment mechanism 216 positioned in at least a portion of the length of the cover 206. FIG. 2 further illustrates a location of the detachment mechanism 216 in the central portion of the cover 206. In some implementations, the detachment mechanism (e.g., ripcord) 216 may positioned in the entire length of the central portion of the cover 206. In other implementations, the detachment mechanism 216 may be positioned in a portion of the cover 206 less than an entire length of the cover 206. Dividable package 200 may also have detachment mechanisms 218 and 220 for accessing the contents stored within each internal compartment formed from the first and second sections 202 and 204, respectively, once the dividable package is folded and separated.

Dividable package 200 may have adhesive strips 222(1)-(2) positioned along a top portion and a bottom portion of the cover 206. Adhesive strips 222(1)-(2) may be used to hold the dividable package in a fully folded position once packed. For instance, the adhesive strips 222(1)-(2) may secure the cover 206 around each of the formed internal compartments while the dividable package is shipped. In some implementations, the adhesive strips 222(1)-(2) may be double sided tape covered with a removable protective sheet.

Figure 3:
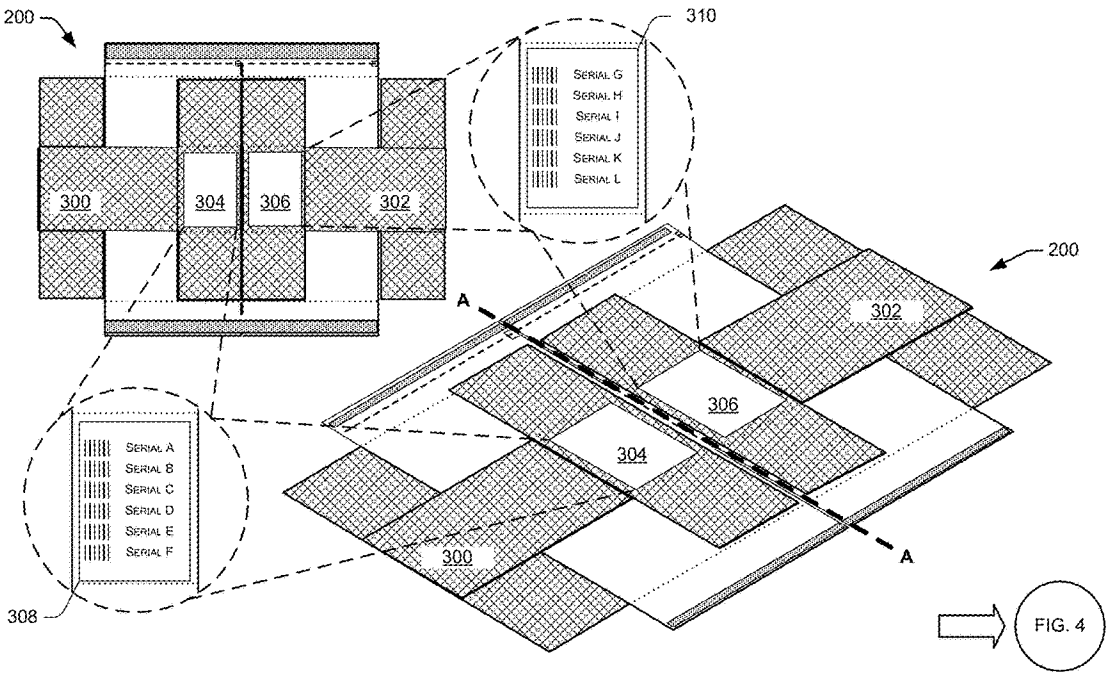

FIGS. 3-7 illustrate example steps of folding, labeling, packing, sealing, and dividing a dividable package. FIG. 3 illustrates a top view of dividable package 200 and a perspective view of dividable package 200 where a first internal compartment 300 and a second internal compartment 302 have yet to be fully formed to house items. In both views, dividable package 200 is shown after folding to partially form the internal compartments 300 and 302 from the first and second sections 202 and 204 as described above with regard to FIG. 2. For ease of illustration, the portions of dividable package 200 that correspond to the internal compartments 300 and 302 are shown as textured.

FIG. 3 illustrates locations 304 and 306 on internal compartment 300 and 302 respectively for placement of a shipping label. As shown, shipping label 308 may include information specifically identifying the contents or items packed or to be pack within internal compartment 300. For instance, shipping label 308 may include barcodes and serial numbers (e.g., Serial A, Serial B, Serial C, and so on) uniquely corresponding to each electronic device packed within internal compartment 300. In some implementations, a second shipping label 310 may be placed at location 306 of internal compartment 302 and include unique identifiers for the items within. In the example shown, the shipping label 310 included barcodes and serial numbers (e.g., Serial G, Serial H, Serial I, and so on) uniquely corresponding to each electronic device packed within internal compartment 302. In other implementations, each shipping label may be placed at another location on each internal compartment.

In some implementations, shipping labels 308 and 310 may be placed at locations 304 and 306 prior to folding and packing dividable package 200. In other implementations, shipping label 308 may be placed at location 304 after packing content within internal compartment 300, while shipping label 310 may be placed at location 306 prior to packing content within internal compartment 302.

Shipping labels 308 and 310, and any other shipping label described herein, may include any number of identifiers for the contents of the dividable package, package origin, package destination, packaging entity, intended recipient, content warnings, or any of other information to aid in shipment and/or identification of the dividable package.

Internal compartments 300 and 302 of dividable package 200 may be formed to house items by folding locations 304 and 306 toward one another along line A. In other words, once the internal compartments are formed to house items, location 304 and 306 are no longer visible and are facing one another. In some implementations, each internal compartment may be folded independent of the other internal compartment.

The process of folding dividable package 200 continues on FIG. 4. FIG. 4 also shows a top view of dividable package 200 and a perspective view of dividable package 200. As shown in FIG. 4, each internal compartment 300 and 302 may be further formed by folding portions of each internal component and closing portions of the third portion or cover 206. In some implementations, flaps 404, 406, 408, and 410 when manipulated along lines B-E may form a bottom surface of each internal compartment. Flaps 404, 406, 408, and 410 may be manipulated in any order.

Upon closing flaps 404, 406, 408, and 410 of each internal compartment, a portion of cover 206 may used to secure the position of each flap in the closed position. In some implementations, adhesive strip 222(2) positioned along a bottom portion of the cover 206 may be used to secure the cover 206 over the bottom portion of each internal compartment. For instance, as shown in FIG. 5, a user may remove a protective sheet above adhesive strip 222(2) and fold the portions of cover 206 to adhere the strip 222(2) to the portions of each internal compartment.

Figure 5:
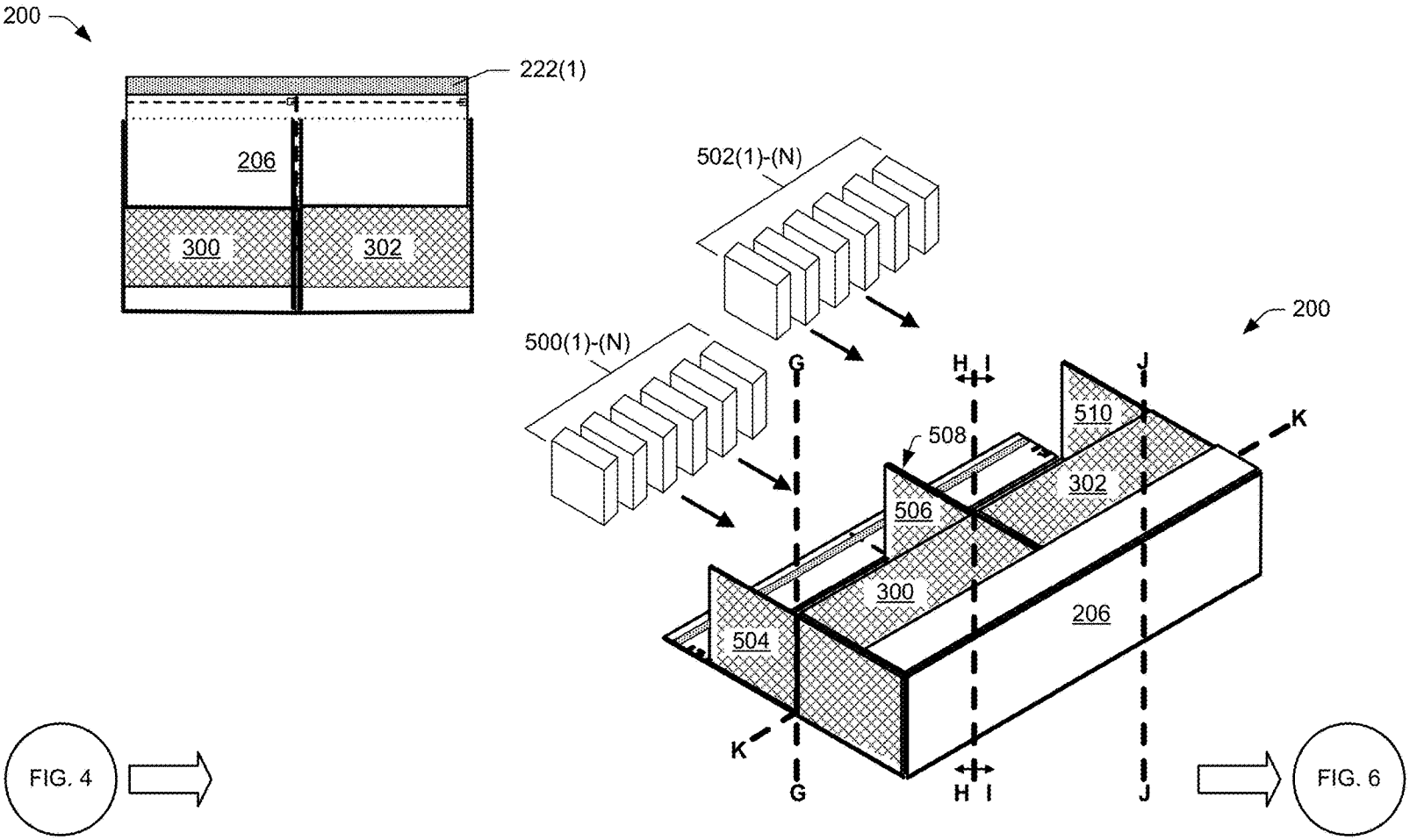

FIG. 5 illustrates that internal compartment 300 and internal compartment 302 of the dividable package 200 may be packed with items. As mentioned above, each internal compartment may be packed with the same type of items. However, in other implementations described below, each internal compartment may be packed with a variety of different types of items. In some implementations, one internal compartment may be packed with a first type of item while the other internal compartment may be packed with a second type of item.

As shown in FIG. 5, items 500(1)-(N) may be placed in the dividable package 200 by, for example, sliding each item of items 500(1)-(N) into internal compartment 300. Similarly, items 502(1)-(N) may be placed in internal compartment 302. Items 500(1)-(N) and 502(1)-(N) may be any type of item that is capable of shipment. In some implementations, items 500(1)-(N) and 502(1)-(N) may be electronic devices capable of rendering content for consumption by a user. Each item of the items 500(1)-(N) and items 502(1)-(N) may include a label individually identifying each item. For instance, where items 500(1)-(N) are electronic devices, each electronic device may be individually labeled with information identifying the electronic device (e.g., serial number, barcode, etc). As discussed below, items 500(1)-(N) and items 502(1)-(N) may be placed into each internal compartment such that when each internal compartment is opened, each individual label identifying each item may be exposed to a user.

In some implementations, items 500(1)-(N) and 502(1)-(N) may be placed within an internal compartment with supplemental materials to protect the items during shipment. For instance, crush pads or other dunnage may be positioned between or around one or more items 500(1)-(N) as they are packed within internal compartment 300 and/or placed between the items and the walls of the internal compartment 300. While FIG. 5 illustrates a plurality of items, in other implementations, each internal compartment may be configured to hold a single item.

Once each internal compartment of the dividable package is packed, the flaps 504, 506, 508, and 510 of each internal compartment may be manipulated similar to as described above with regard to FIG. 4. For instance, flaps 504, 506, 508, and 510 may be folded along lines G-J may form a top surface of each internal compartment. Once folded, a portion of cover 206 may used to secure the position of each flap in the folded position. In some implementations, the adhesive strip 222(1) may be used to secure the portion of cover 206 over the folded flaps 504, 506, 508, and 510.

Figure 6:
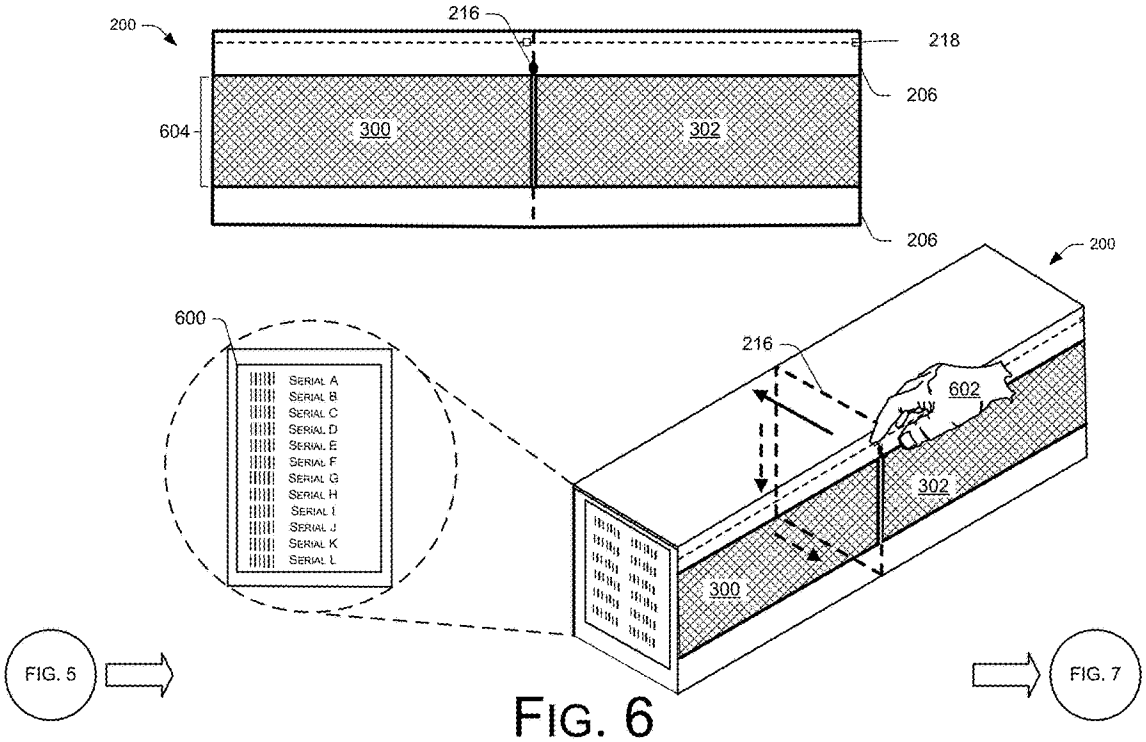

FIG. 6 illustrates a fully folded and packed dividable package 200 that may be ready for shipment to a destination. FIG. 6 also illustrates an example master shipping label 600 which may be used to identify the items with the dividable package 200. That is, master shipping label may identify the content of both internal compartment 300 and internal compartment 302. To continue the example of dividable package 200 and the shipping label 308 and 310 illustrated in FIG. 3 and located on internal compartments 300 and 302 respectively, master shipping label may include the information (i.e., Serial A-L) listed on both shipping label 308 and 310. In some implementations, master shipping label may contain fewer or additional details than each of the shipping labels on the internal compartments.

Master shipping label 600 may be customized to include specific package details as requested by the package recipient. For instance, the master shipping label may include readable bar codes such that the intended recipient's package processing equipment may read and process the dividable package. In some implementations, the master shipping label may be configured to tear-way from the dividable package 200 upon separation of the internal compartments.

In some implementations, once the dividable package 200 is folded, packed, and label with a master shipping label it may be shipped to a destination. As described above with reference to FIG. 1, the dividable package 200 may be placed on a pallet with a plurality of other dividable packages. At the destination, a user 602 (e.g., human or machine) may remove each dividable package for the pallet. In some implementations, the user 602 may separate the dividable package 200 in order to further process the each internal compartment within.

In some instances, the user 602 may separate the compartment of the dividable package 200 by pulling on the detachment mechanism 216 on the cover 206. As shown in FIG. 6, user 602 may begin to separate internal compartment 300 from internal compartment 302 by pulling the detachment mechanism 216 along the dashed line in a direction indicated by the arrows. In some implementations, as the user 602 pulls the detachment mechanism 216 substantially around the circumference of the cover 206 the internal compartment 300 may be separated from the internal compartment 302 as shown in FIG. 7.

FIG. 6 also illustrates an area 604 on the dividable package 200 where each internal compartment 300 and 302 is exposed between the folded ends of cover 206. In some implementations, one folded end of cover 206 may extend to contact of other folded end of cover 206 such that each internal compartment 300 and 302 is not visible once the cover 206 is folded in place. In this implementation, the folded ends of cover 206 may be held in place by the adhesive strips described above and/or with an adhesive tape placed on an exterior portion of the dividable package 200.

Figure 7:
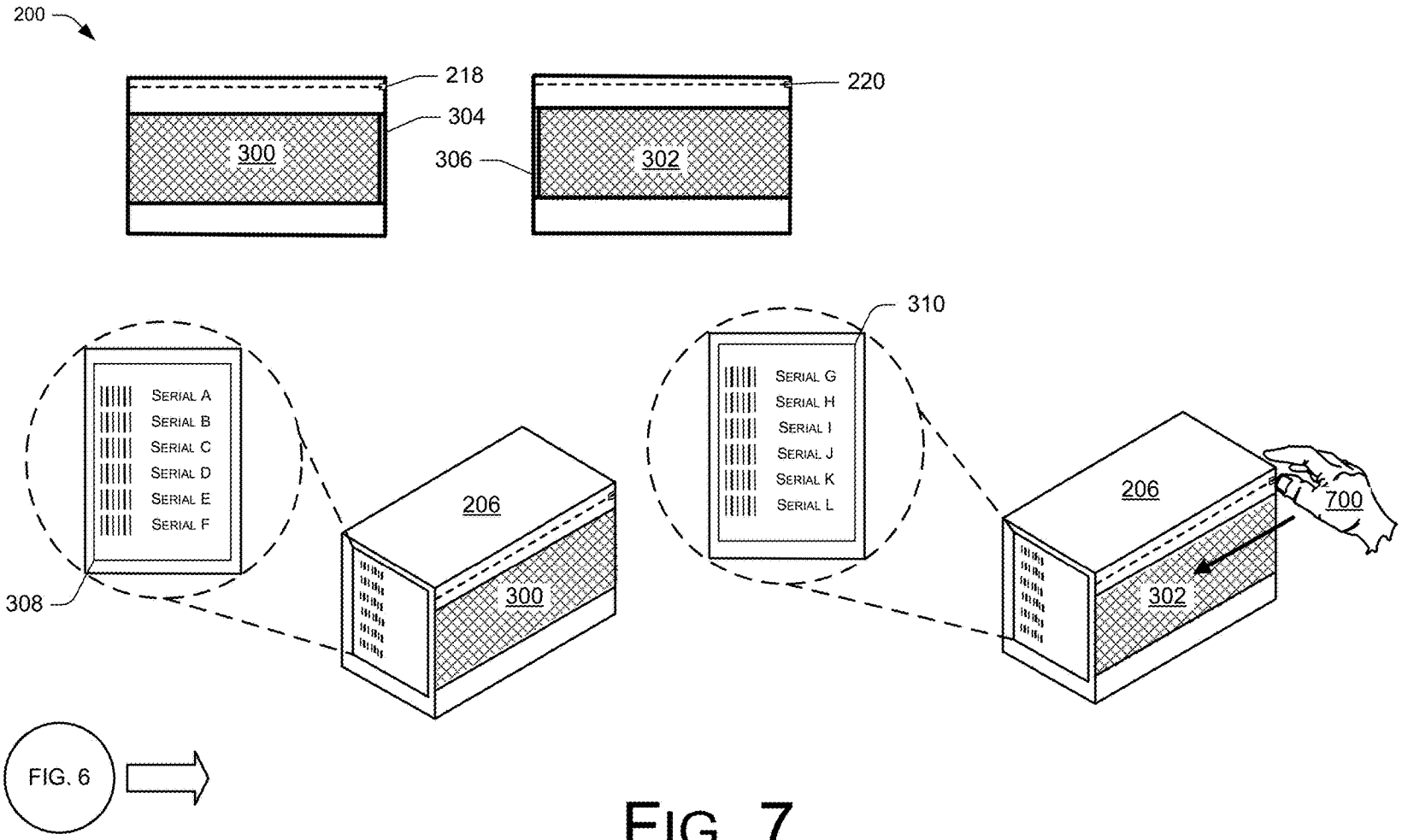

FIG. 7 also illustrates the re-exposure of locations 304 and 306 of internal compartments 300 and 302 upon separate of dividable package 200. Thus, the separation of the dividable package 200 also re-exposes the shipping labels 308 and 310 independently identifying the contents of each of the internal compartments 300 and 302.

As mentioned above, the separated portions of the divided package 200 may comply with the recipient's processing requirements where the un-separated dividable package including larger quantity of items would not comply with the processing requirements. In some implementations, the separated portion of the divided package may be further processed by an initial recipient and then each separated portion of the divided package may be shipped to a subsequent recipient.

The subsequent recipient (e.g., user 700) may access the contents of internal compartment of each separated portions of the divided package by operating a detachment mechanism (i.e., 218 or 220) on each. For instance, a user 700 may pull a tab on cover 206 in order to pull a ripcord integrated within a portion of the cover 206 to cut the cover 206. In this example, the user 700 may flip the top portion of cover 206 up to access the items secured within the internal compartment 204. In some implementations, upon opening the top portion of cover 206, the individual labels of each item housed within the internal compartment may be revealed to a user.

Alternative Dividable Packages

FIGS. 8A-12 illustrate various alternative dividable packages. While the implementations described in this section may have a different configuration than those described above, it is to be understood that each alternative implementation described below has a similar function to the implementations described above. That is, each dividable package implementation below may have multiple, individually labeled dividable compartments for securing products during processing and transit.

Figure 8A:
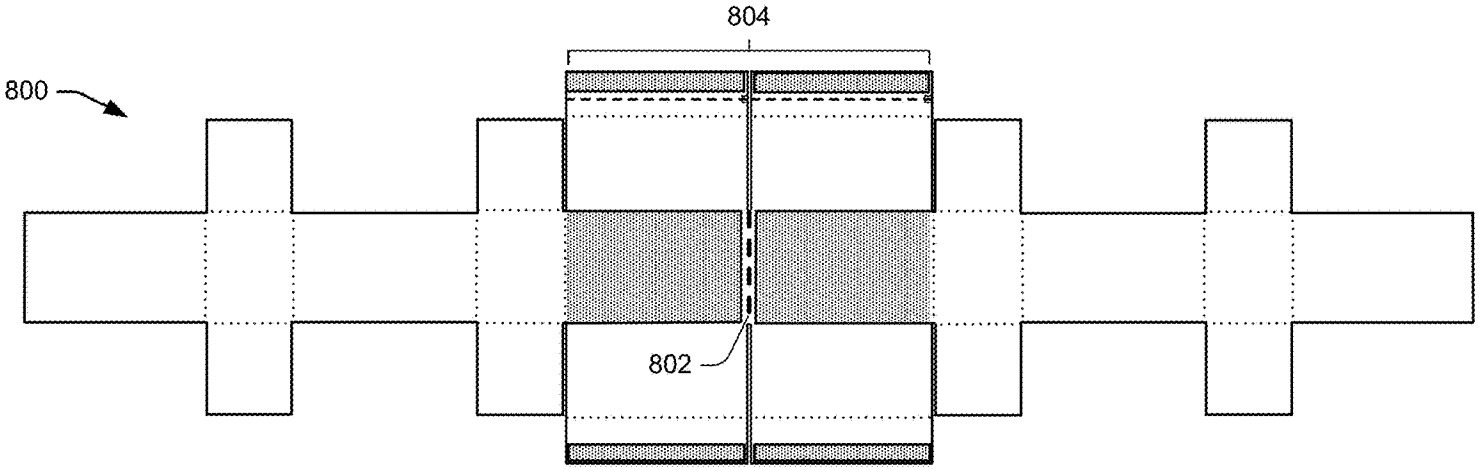
FIGS. 8A and 8B illustrate a top view and a perspective view of an example dividable package having a detachment mechanism located within a portion of a dividable package cover.
Figure 8B:
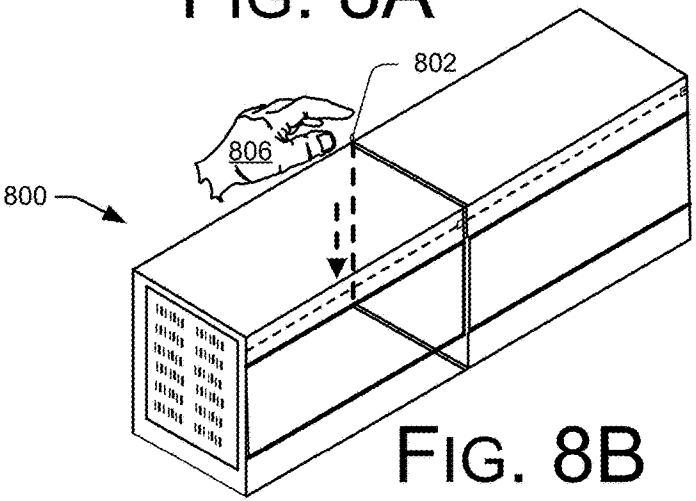

FIGS. 8A and 8B illustrate an example dividable package 800 having a detachment mechanism in a portion of cover of the dividable package 800. FIG. 8A illustrates a top view of an unfolded dividable package 800 while FIG. 8B illustrates a perspective view of a folded dividable package 800.

As shown in FIG. 8A, dividable package 800 may have a detachment mechanism 802 (e.g., a ripcord, pull strip, etc) integrated with a portion of cover 804. The detachment mechanism 802 is illustrated at a central portion of cover 804. In some implementations, the location of the detachment mechanism 802 may be the only location holding the separable portions of dividable package 800 together. In some implementations, the location of the detachment mechanism 802 may correspond to one side of the folded dividable package 800.

FIG. 8B shows a user 806 may manipulate the detachment mechanism 802 to separate the dividable package 800. As shown, the user 806 may pull the detachment mechanism 802 in the direction of the arrow until the separable portions of the dividable package are separated.

Figure 9:
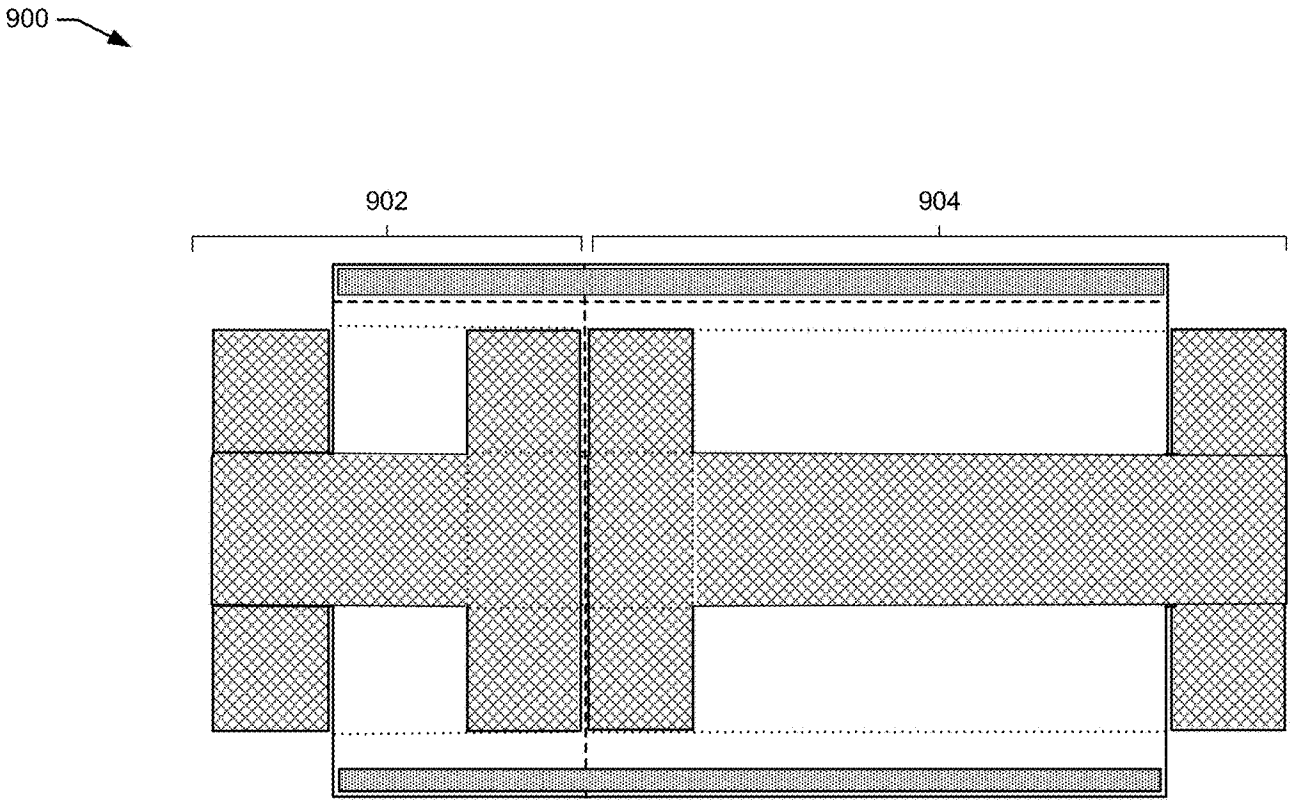
FIG. 9 illustrates an example dividable package having internal compartment of varying sizes capable of secure a different amount of the same type of items.

FIG. 9 illustrates a dividable package 900 where the separable portions (i.e., internal compartments and corresponding section of the cover) may be different sizes capable of securing a different number of items. In some implementations, packing and shipping items such that each separable portion of a dividable package contain a different quantity of items may be desirable. FIG. 9 shows a dividable package 900 having a portion 902 which may hold items for shipment and a portion 904 which may hold items for shipping in a quantity larger than portion 902. In some implementation, each portion 902 and 904 may hold the same type of items while, in other implementations, each portion 902 and 904 may hold different type of items.

Figure 10:
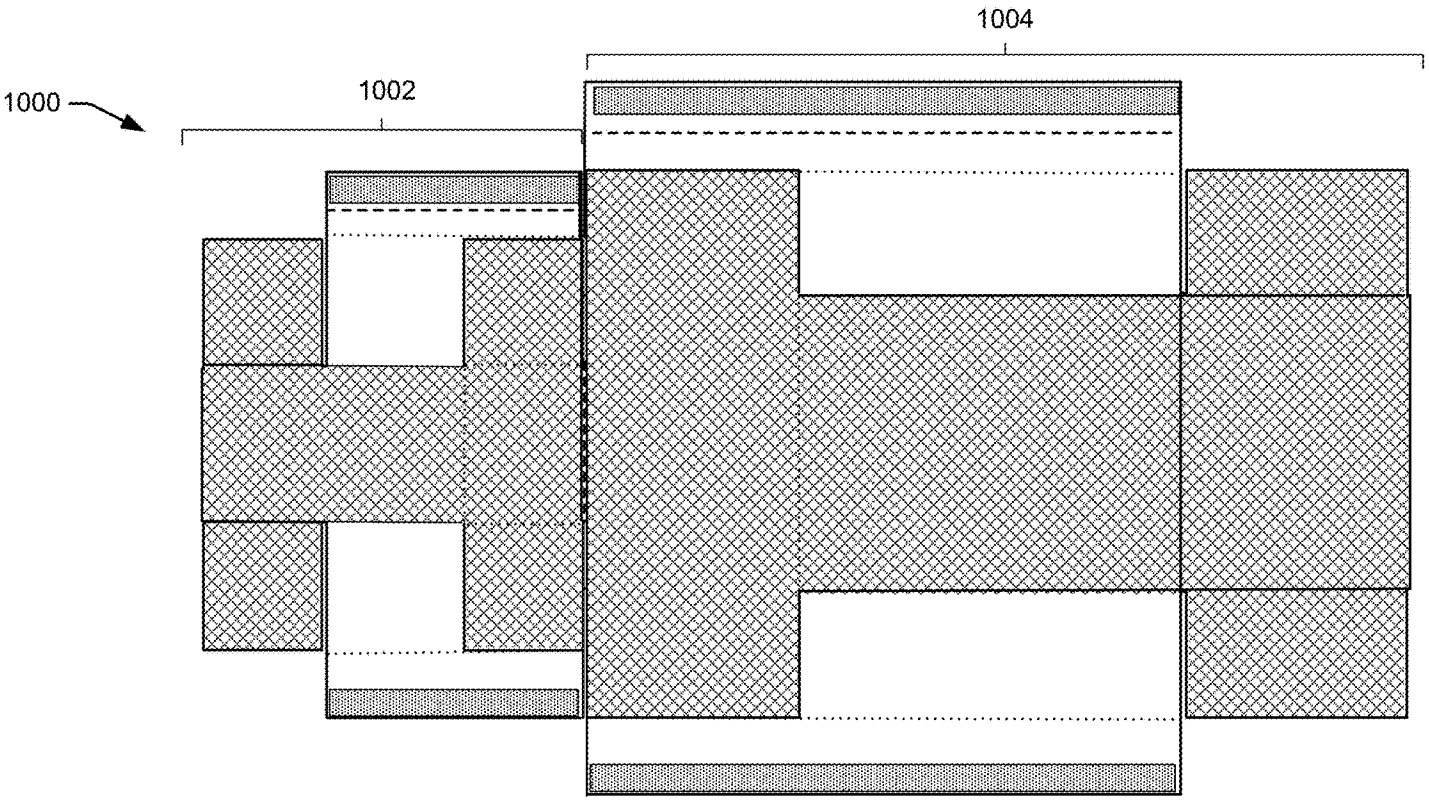
FIG. 10 illustrates an example dividable package having internal compartment of varying sizes capable of secure items of different sizes or types.

FIG. 10 illustrates a dividable package 1000 where the separable portions (i.e., internal compartments and corresponding portions of the cover) may be different sizes capable of securing items of different sizes. In some implementations, packing and shipping larger items in a dividable package together with supplemental items that correspond to the larger item may be desirable. For instance, imagine the larger item is a laser printer and the supplemental items are ink cartridges corresponding to the laser printer. FIG. 10 shows that the supplemental item(s) may be secured in the smaller portion 1002 of the dividable package 1000 while the larger item(s) may be secured in the larger portion 1004 of the dividable package 1000.

Figure 11:
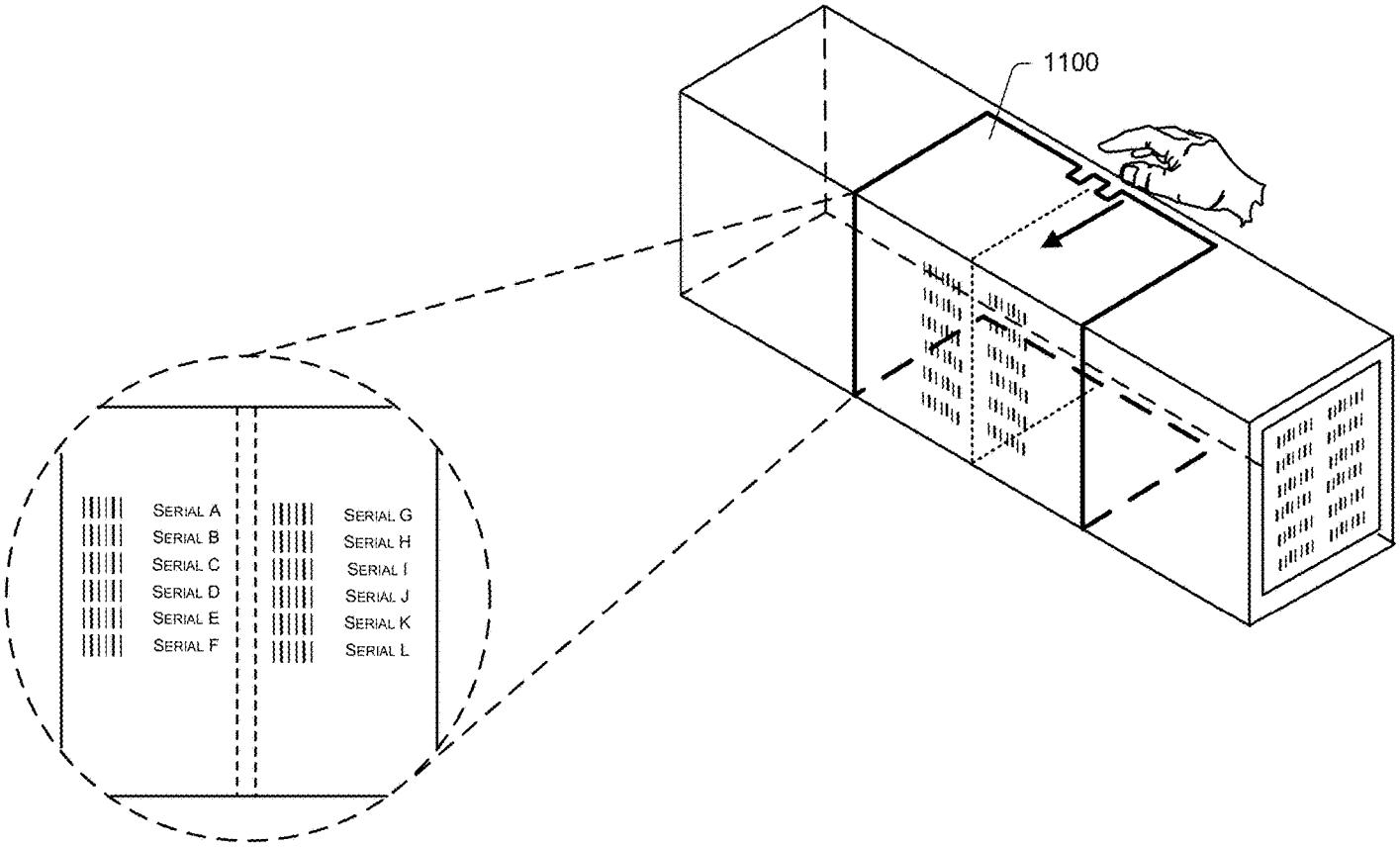
FIG. 11 illustrates an example dividable package having a printable label to identify the items within the dividable package capable of supplementing or serving as a detachment mechanism.

FIG. 11 illustrates another implementation of labeling a dividable package for shipment with a printable seal 1100. As shown, the printable seal 1100 with an adhesive backing may be place over the detachment location of an example dividable package to identify the contents of the separable portions of the dividable package. In some implementations, the seal 1100 may identify the entire content of the dividable package while the package is undivided. Upon division of the dividable package, a portion of the seal 1100 may remain attached to the separated portion of the dividable package to identify the contents of each.

In some implementations, the seal 1100 may supplement any of the detachment mechanisms described above. For example, the seal 110 may be integrated with the detachment mechanism such that when the detachment mechanism is manipulated, the seal 1100 is also divided.

In other implementation, the seal 1100 may be configured to attach the separable portion of the dividable package. In this instance, the seal 1100 may also serve as a detachment mechanism to separate the dividable package and the seal 110 may be comprised a durable polymer configured to tear in a specific direction. As illustrated in FIG. 11, a user may pull the seal along the dashed line in order to separate the dividable package.

Example Processes

Figure 12:
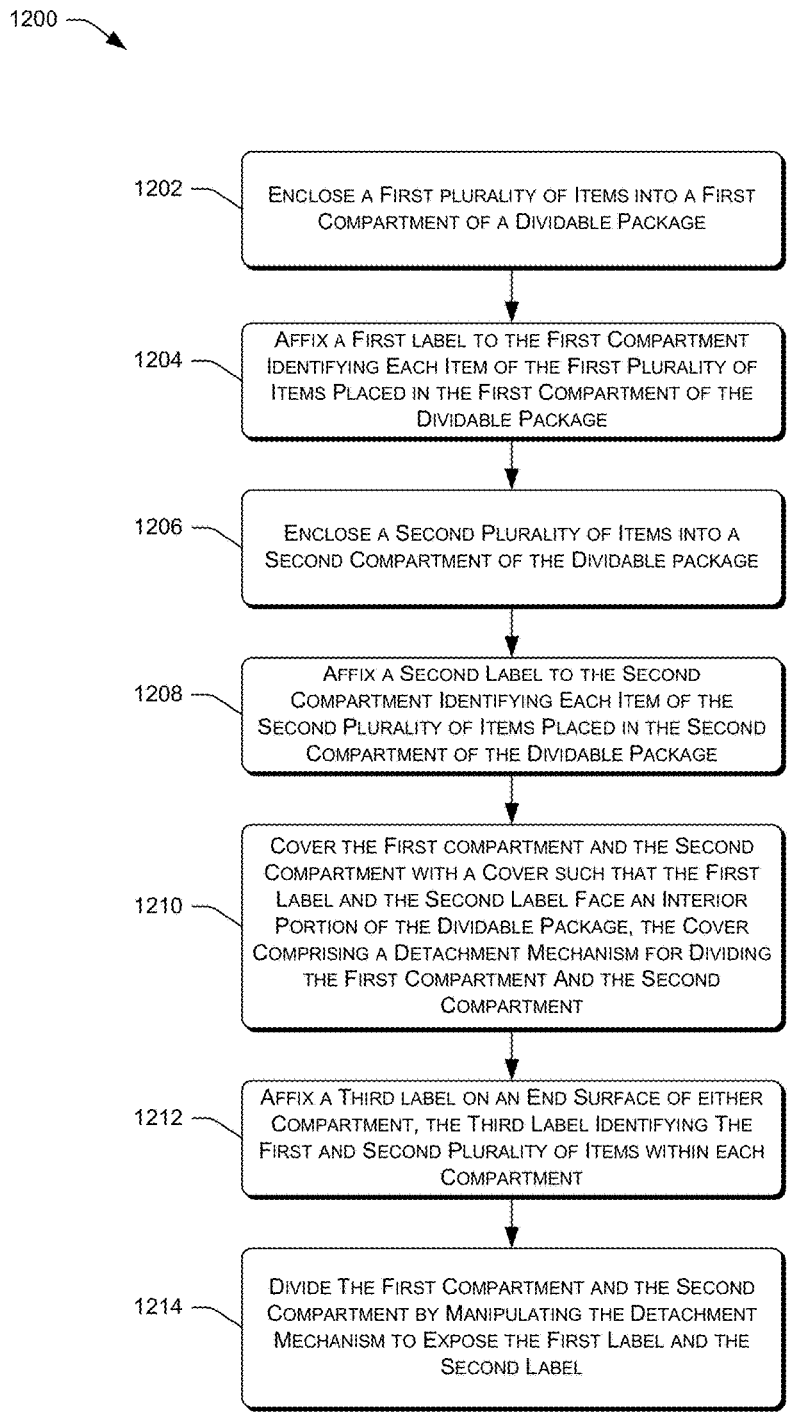
FIG. 12 is a flow diagram that illustrates an example process of labeling, packing, sealing, and dividing an example dividable package.

FIG. 12 illustrates an example process 1200 for implementing the techniques described above of loading a bulk box with an assortment of packages. The process 1200 is illustrated as a logical flow graph where each operation may represent a sequence of operations. Additionally, the order in which the operations are described is not intended to be construed as a limitation, and any number of the described operation can be combined in any order and/or in parallel to implement the process.

The process 1200 includes, at 1202, enclosing a first plurality of items into a first compartment of a dividable package. In the context of FIG. 5, the plurality of items 500(1)-(N) may be placed into internal compartment 300 of dividable package 200. As described above, each of the plurality of items 500(1)-(N) may be individually labeled.

At 1204, a first label may be affixed to the first compartment identifying each item of the first plurality of items placed within the first compartment of the dividable package. For instance, as shown in FIG. 3, a shipping label 308 may be placed at the area 304 on the internal compartment 300.

At 1206, a second plurality of items may be enclosed into a second compartment of the dividable package. Again, in the context of FIG. 5, items 502(1)-(N), which may be individually labeled, may be secured within internal compartment 302.

At 1208, a second label may be affixed to the second compartment identifying each item of the second plurality of items placed within the second compartment of the dividable package. For instance, as shown in FIG. 3, a shipping label 310 may be placed at the area 306 on the internal compartment 302.

At 1210, a cover coupling the first compartment and the second compartment may be closed such that the first label and the second label face and interior portion of the dividable package. For instance, as shown between FIGS. 3-6, areas 304 and 306 and corresponding shipping labels 308 and 310 are not visible once the dividable package is loaded and the cover is closed.

At 1212, a third label may be placed on an end surface of either compartment, the third label identifying the first and second plurality of items within the first compartment and the second compartment. In the context of FIG. 6, master shipping label may be placed on an end location of internal compartment 300 and contain the information of each individual shipping labels 308 and 310 on the interior portion of the dividable package.

At 1214, the first compartment and the second compartment may be divided by manipulating a detachment mechanism on the cover. Upon dividing the compartments, each of the first label and the second label may be exposed. For instance, the progression form FIG. 6 to FIG. 7 illustrates the pulling of the detachment mechanism 216 to divide the dividable package 200 and as a result exposing the shipping labels 308 and 310 on each internal compartment.

Conclusion

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A dividable package comprising:

a first section for folding into a first compartment, the first compartment having a first surface and configured to enclose one or more first items;

a first label disposed on the first surface of the first compartment, the first label including at least a first identifier of a first item from the one or more first items;

a second section for folding into a second compartment, the second compartment having a first surface and configured to enclose one or more second items;

a second label disposed on the first surface of the second compartment, the second label including at least a second identifier of a second item from the one or more second items, the second label being positioned to substantially face the first label on the first compartment when the one or more first items are enclosed in the first compartment and the one or more second items are enclosed in the second compartment, wherein the first identifier is different than the second identifier;

a third section for covering the first compartment and the second compartment, the third section holding the first compartment and the second compartment in a rectangular cuboid and comprising a detachment mechanism substantially perpendicular to a long axis of the rectangular cuboid for dividing the first compartment from the second compartment; and a third label disposed on a second surface of either the first compartment or the second compartment, the third label including at least the first identifier of the first item and the second identifier of the second item.

2. The dividable package as recited in claim 1, wherein the detachment mechanism comprises a plastic cord integrated with the third section and, when activated, cuts a portion of the third section to physically separate the first compartment from the second compartment.

3. The dividable package as recited in claim 2, wherein the first label of the first compartment and the second label of the second compartment are exposed when the detachment mechanism is activated to physically separate the first compartment from the second compartment.

4. The dividable package as recited in claim 1, wherein the third section further comprises a first adhesive along a top portion of the third section and a second adhesive along a bottom portion of the third section, wherein the first adhesive is configured to attached the top portion of the third section to the first compartment and the second compartment and the second adhesive is configured to attach the bottom portion of the third section to the first compartment and the second compartment.

5. A dividable package system comprising:

a first compartment with a first cuboid shape to hold a first set of one or more items, the first compartment having a first label to identify the first set of one or more items;

a second compartment with a second cuboid shape to hold a second set of one or more items, the second compartment having a second label, distinct from the first label to identify the second set of one or more items; and a cover to enclose the first compartment and the second compartment to form a rectangular cuboid comprising the first cuboid shape and the second cuboid shape, the cover comprising:

a first detachment mechanism configured to, when activated along at least a portion of a short axis of the rectangular cuboid, separate the first compartment from the second compartment;

a second detachment mechanism configured to, when activated along a first portion of a long axis of the rectangular cuboid, separate a first portion of the cover from the first compartment to provide access to the first set of one or more items held within the first compartment; and a third detachment mechanism configured to, when activated along a second portion of the long axis of the rectangular cuboid, separates a second portion of the cover from the second compartment to provide access to the second set of one or more items held within the second compartment.

6. The dividable package system as recited in claim 5, further comprising:

the first label disposed on an outer surface of the first compartment; and the second label disposed on an outer surface of the second compartment, wherein the first label and the second label are not visible when the cover encloses the first compartment and the second compartment.

7. The dividable package system as recited in claim 6, further comprising a third label to identify the first set of one or more items and the second set of one or more items and wherein the third label is visible while the cover encloses the first compartment and the second compartment.

8. The dividable package system as recited in claim 5, wherein the detachment mechanism is positioned in a portion of the cover less than an entire length of the short axis of the rectangular cuboid of the cover.

9. The dividable package system as recited in claim 5, wherein the first detachment mechanism, the second detachment mechanism, and the third detachment mechanism each comprises a plastic cord integrated with the cover.

10. The dividable package system as recited in claim 5, wherein a top portion and a bottom portion of the cover comprise an adhesive, wherein the adhesive is configured to attached the top portion and the bottom portion of the cover to the first compartment and the second compartment.

11. The dividable package system as recited in claim 5, wherein the first compartment, the second compartment, and the cover each comprise one of a corrugated fiberboard, a corrugated plastic, or a combination thereof.

12. A package comprising:

a cover with a rectangular shape;

a first compartment enclosed by the cover;

a second compartment enclosed by the cover;

at least one detachment mechanism for dividing the first compartment from the second compartment;

a first label that is not visible while the first compartment is enclosed by the cover, the first label including at least a first identifier of a first item included in the first compartment;

a second label that is not visible while the second compartment is enclosed by the cover, the second label including at least a second identifier of a second item included in the second compartment; and a third label that is visible while the first compartment and the second compartment are enclosed by the cover, the third label including at least the first identifier of the first item and a second identifier of the second item.

13. The package as recited in claim 12, wherein:

the first identifier includes one or more of a first serial number, a first serial code, a first unique device identification, a first universal product code, a first stock keeping unit, a first Global Trade Item number, or a first Amazon Standard Identification Number; and the second identifier includes one or more of a second serial number, a second serial code, a second unique device identification, a second universal product code, a second stock keeping unit, a second Global Trade Item number, or a second Amazon Standard Identification Number.

14. The package as recited in claim 12, wherein the first compartment and the second compartment further comprises two or more crush pads to protect the first item and the second item for shipment.

15. The package as recited in claim 12, wherein the first compartment is configured to hold a same number of items as the second compartment.

16. The package as recited in claim 12, wherein the first compartment is configured to hold a same type of items as the second compartment.

17. The package as recited in claim 12, wherein the detachment mechanism comprises a plastic cord integrated with the cover and, when activated, cuts a portion of the short axis of the rectangular shape of the cover.

18. The package as recited in claim 12, wherein a top portion and a bottom portion of the cover include an adhesive, wherein the adhesive is configured to attached the top portion and the bottom portion of the cover to at least the first compartment and the second compartment.

19. The package as recited in claim 12, wherein:

the first label includes a first plurality of identifiers, the first plurality of identifiers including the first identifier;

the second label includes a second plurality of identifiers, the second plurality of identifiers including the second identifier; and the third label includes the first plurality of identifiers and the second plurality of identifiers.

* * * * *